United States Patent [19]

Carter

[11] Patent Number: 4,899,880

[45] Date of Patent: Feb. 13, 1990

[54] FOAM PACKAGING SEPARATOR

[75] Inventor: Alan T. Carter, Village of White Pigeon, Mich.

[73] Assignee: Carter Associates, Inc., Sturgis, Mich.

[21] Appl. No.: 316,490

[22] Filed: Feb. 28, 1989

[51] Int. Cl.[4] ..... B65D 85/48; B65D 81/08; B32B 3/30

[52] U.S. Cl. ..... 206/448; 206/454; 206/523; 206/585; 206/593; 211/41; 428/159; 428/173; 428/213; 428/316.6; 428/319.1

[58] Field of Search ..... 206/448, 449, 454, 523, 206/591, 593, 594, 585, 453, 451; 211/40, 41, 29; 428/212, 316.6, 319.1, 213, 159, 173; 410/35, 39

[56] References Cited

U.S. PATENT DOCUMENTS

| | | | |
|---|---|---|---|
| 1,815,558 | 7/1931 | Gammeter | 428/173 X |
| 2,714,570 | 8/1955 | Brown | 206/594 X |
| 3,216,564 | 11/1965 | Wolfe, Jr. et al. | 206/448 |
| 3,385,462 | 5/1968 | Deldine et al. | 206/448 X |
| 3,496,043 | 2/1970 | Ragan | 428/212 X |
| 3,746,605 | 7/1973 | Dillon et al. | 428/159 |
| 3,812,001 | 5/1974 | Ryan | 206/594 X |
| 3,955,676 | 5/1976 | Hansen et al. | 206/451 |
| 4,242,397 | 12/1980 | Ferment et al. | 428/159 X |
| 4,313,987 | 2/1982 | McCormick | 428/159 X |

FOREIGN PATENT DOCUMENTS

| | | | |
|---|---|---|---|
| 0082685 | 6/1983 | European Pat. Off. | 206/523 |
| 1332546 | 10/1973 | United Kingdom | 206/448 |

*Primary Examiner*—Bryon P. Gehman

*Attorney, Agent, or Firm*—Flynn, Thiel, Boutell & Tanis

[57] ABSTRACT

A packaging separator adapted to be disposed in load bearing engagement between a pair of articles, such as windshields. The separator includes a sheet-like supporting element constructed of a generally nonresilient plastic foam and having enlarged opposed side surfaces for respectively contacting opposed surfaces associated with a pair of adjacent windshields. The supporting member has one or more shallow recesses formed inwardly from one of said side surfaces, and each recess contains therein a sheet-like gripping pad constructed of a resilient foam. The gripping pad, in a resiliently nondeformed condition, has a thickness which is significantly greater than the depth of the recess to define an outer gripping surface which extend generally parallel with but is normally spaced outwardly from the respectively adjacent side surface of the supporting element. The gripping pad is resiliently compressed by engagement with the windshield to the extent that the gripping pad projects beyond the respective side surface, thereby controlling the gripping pressure between the gripping pad and the adjacent windshield, with the primary force transfer occurring due to direct engagement between the windshield and the first side surface.

15 Claims, 1 Drawing Sheet

FOAM PACKAGING SEPARATOR

FIELD OF THE INVENTION

This invention relates to an improved packaging separator for use between stacked objects, such as windshields.

BACKGROUND OF THE INVENTION

Windshields for vehicles are generally disposed in a stack supported on and secured to a rack so as to permit handling, storage and shipment, such as from the windshield manufacturer to the vehicle assembler. The windshields are normally oriented such that the elongate direction thereof projects upwardly so that the windshield is supported by its lower edge on a rack, and a plurality of such windshields are then disposed in closely adjacent relationship to one another on the rack so as to form a substantially horizontally-extending stack. The stack of windshields is secured to the rack by any conventional means, such as by banding straps.

To protect the adjacent windshields when they are stacked and strapped on the rack, it has been conventional to provide packaging separators of a plastic foam disposed between the adjacent windshields. For example, one conventional packaging separator which has been extensively utilized for this purpose involves a sheet-like packaging member formed from a thin sheet of a rigid beaded polystyrene foam. This known packaging separator is conventionally of substantial size, such as having a width dimension of about 30 inches, a length dimension of about 30 inches, and a thickness of about ¼ inch.

While this known packaging separator is highly effective in providing proper but minimal clearance between adjacent windshields so as to permit packaging and shipping thereof, and also ease of removal of the windshields when use is desired at the vehicle assembler, nevertheless this known separator possesses features which have been less than desirable. Most specifically, this known separator is costly because of its size and the quantity of plastic material required. The size of this separator also creates additional disadvantages with respect to storing, handling and disposing of the separators.

In an attempt to overcome many of the disadvantages associated with the known separator described above, the Applicant previously proposed a separator which was of substantially smaller size so as to significantly reduce the storing, handling and disposing problems, and which was also of significantly less material so as to reduce the cost. This reduced-size separator has a length of about 30 inches, a thickness in the order of about ¼ inch, but a width of only about 1 inch. This proposed separator is defined by a narrow elongate strip of rigid plastic foam having generally parallel opposed side surfaces and, as shown in FIG. 6, one of these side surfaces has two small and spaced patches or strips of highly-plasticized polyvinyl chloride (PVC) foam patches adhered to one side thereof so as to project outwardly from the one-side of the rigid layer. With this arrangement, however, it was discovered that use of beaded polystyrene foam was less than optimum since the smaller size of the rigid board prevented it from possessing the desired strength necessary for removal, and hence breakage readily occurred. To improved thereon, the rigid foam board was extruded of polystyrene foam so as to provide a dense outside skin. This does provide a significantly improved strength. Even with this improvement, however, it was observed that the packaging separator became too tightly bonded to the windshield and could not be separated from the windshield without breakage of the separator. More specifically, the PVC foam patches almost totally flattened when the separator was positioned between adjacent windshields and the windshields were banded together. This substantially total flattening of the PVC foam patches, due to their very small area and the fact that they constituted the primary pressure-transfer area between the windshield and the rigid board, resulted in extremely high pressure between the windshield and the PVC foam patches. This high pressure created such a high adhesion of the patch to the windshield that, when it was desired to separate the windshields and remove the separators, the separators could not be readily detached from the windshield.

Accordingly, the present invention relates to an improved packaging separator which is believed to overcome the many problems and disadvantages which have been briefly summarized above.

In the improved packaging separator of the present invention, the separator is formed primarily by a rigid foam backing sheet which is normally rather thin and has generally parallel side surfaces. A shallow recess or depression is formed inwardly from one of the side surfaces of the rigid backing sheet, this recess being defined by a bottom wall or surface which is generally parallel with but located between the side surfaces of the backing sheet. A thin layer of an adhering plastic foam, such as a highly-plasticized PVC foam pad, is positioned within the recess so that the back surface of this PVC foam pad is adhered to the bottom wall of the recess. This PVC foam pad has a thickness which exceeds the depth of the recess so that it projects outwardly of the recess beyond the side surface of the backing sheet, whereby the PVC foam pad has an exposed surface adapted for contacting an object, such as a windshield, which is spaced outwardly from the adjacent side surface of the backing sheet when the pad is in a noncompressed condition. When the packaging separator is located between two objects such as windshield, this PVC foam pad is initially contacted by the one windshield and compressed until the backing sheet also comes into contact with the same windshield, whereby the contact pressure is then distributed over the complete surface area of the packaging separator. The permissible compression of the PVC foam pad is thus limited in that it cannot be compressed to a substantially flatten condition in view of its being positioned within the shallow recess. This thus controls the adhesive or gripping pressure which exists between the foam pad and the windshield, and facilitates the separation of the windshields and the ultimate removal of the packaging separators.

The packaging separator of the present invention, as briefly summarized above, when used to permit stacking or packaging of windshields, preferably has the backing sheet formed as a elongate strip, such as having width and length dimensions of about 1 inch and 30 inches respectively, and prefereably has two shallow recessed formed therein spaced longitudinally therealong so that each recess in turn accommodates a PVC foam pad, the pad typically having length and width dimensions of about 1 inch by 1 inch.

The improved packaging separator is particularly advantageous in that it can be inexpensively manufactured since it requires use of a minimal quantity of plastics material, and it can also be economically and compactly stored, handled and ultimately disposed of because of its extremely small and compact size.

Other objects and purposes of the invention will be apparent to persons familiar with structures of this general type upon reading the following specification and inspecting the accompanying drawings.

Figure 1:
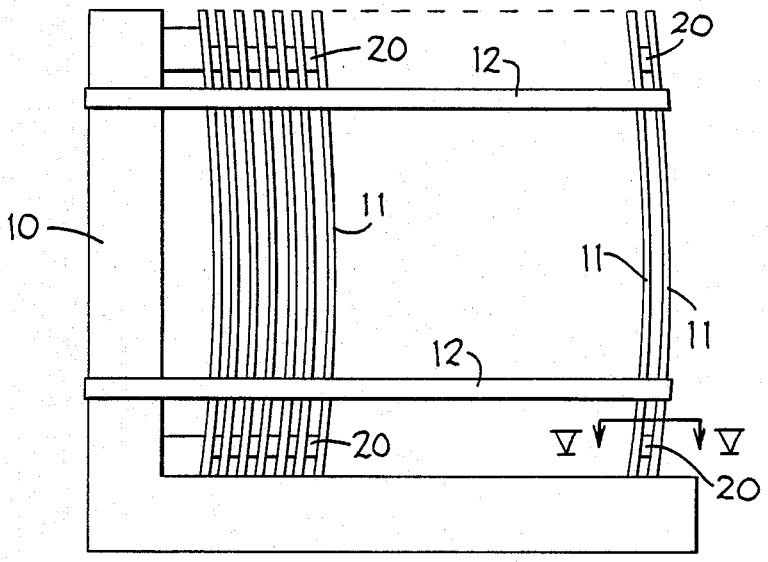
FIG. 1 diagrammatically illustrates a storage and transport rack having a stack of windshields supported and banded thereon.

Certain terminology will be used in the following description for convenience in reference, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the structure and designated parts thereof. Said terminology will include the words specifically mentioned, derivatives thereof, and words of similar import.

DETAILED DESCRIPTION

FIG. 1 diagrammatically illustrates a rack or structure 10 used to store and transport articles, specifically windshields 11. The windshields are disposed so that the longitudinal extent thereof is oriented generally vertically, whereby the windshields are supported on the rack by means of engagement with their lower edges. The windshields are stored in closely adjacent but slightly spaced relationship, this being referred to as a stacked relationship. The windshields are stationaryly secured and supported on the rack by any conventional securing technique, such as conventional bands or straps 12. To maintain a minimal spacing between the stacked windshields 11, packaging separators 20 are conventionally positioned between each adjacent pair of windshields. Such separators 20, constructed according to the present invention, are illustrated in FIG. 1. Preferably a pair of separators 20 are disposed between each adjacent pair of windshields, one being disposed in the vicinity of each of the upper and lower ends of each adjacent pair.

Figure 4:
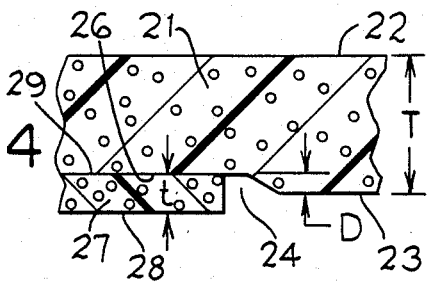
FIG. 4 is a fragmentary enlarged sectional view of a part of FIG. 2.
Figure 2:
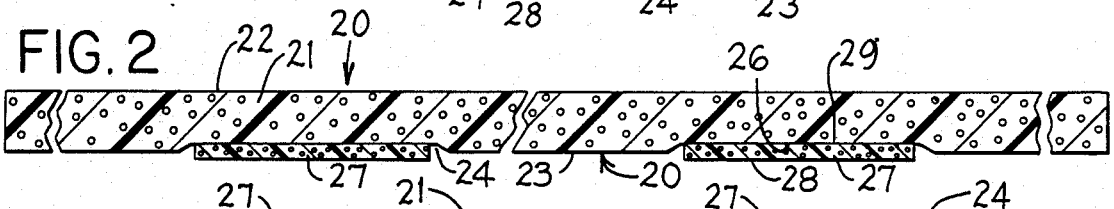
FIG. 2 is a central longitudinally-extending sectional view through the improved packaging separator of the present invention, the separator being illustrated in its nonuse or noncompressed condition.
Figure 3:
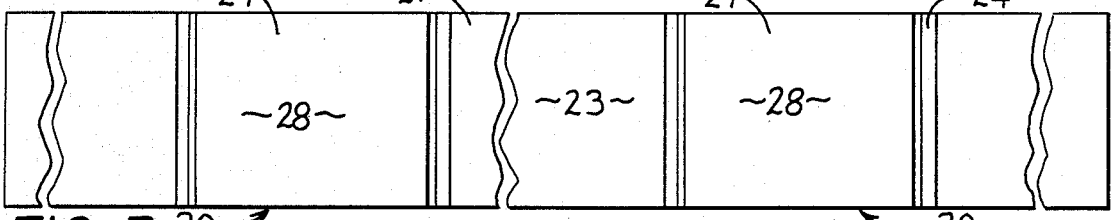
FIG. 3 is a bottom view of the separator illustrated in FIG. 2.

The packaging separator 20 according to the present invention, as illustrated by FIGS. 2–4, includes a backing sheet 21 constructed of a generally rigid plastic foam, such as extruded polystyrene. This backing sheet has opposite and generally parallel side surfaces 22 and 23 which are adapted to respectively contact surfaces of an adjacent pair of windshields when in use. The backing sheet 21 has length and width dimensions which are substantially greater than its thickness dimension and, when designed for use between windshields, the length dimension of the backing sheet preferably exceeds the width dimension by a ratio of 10 or more. In a practical embodiment, the backing sheet 21 has a length dimension of about 30 inches, a width dimension of about 1 inch, and a thickness dimension (that is, the vertical extent in FIG. 2) of about ¼ inch.

The backing sheet 21 has one or more shallow recesses or depressions 24 formed inwardly from one of the surfaces thereof. In the preferred embodiment, the backing sheet 21 has two such recesses 24 formed inwardly from the surface 23, with these recesses 24 being spaced apart from one another in the longitudinal extent of the backing sheet. These recesses 24, in the preferred embodiment, extend across the full width of the backing sheet. Each recess 24 is defined by a substantially flat bottom wall or surface 26 which is generally parallel with the side surface 23 but is located between the side surfaces 22 and 23. The recess 24 has a depth D, as measured perpendicularly between the planes of the surfaces 23 and 26, which is preferably in the range of between about 0.3 to 0.5 the thickness T of the backing sheet 21. This depth D preferably is not less than about 0.2 T, and no greater than about 0.8 T.

The separator 20 also includes a resilient gripping pad 27 positioned within each recess 24 and fixedly adhered to the backing sheet 21, which gripping pad creates a desired gripping or adhering relationship with an objection such as a windshield 11.

The gripping pad 27 is formed of a thin plastic foam sheet, such as a highly-plasticized PVC, having a high degree of resiliency or compressibility. This gripping pad has an exposed surface 28 which extends generally parallel with the side surface 23, and also has a back surface 29 which overlies the bottom wall 26 of the recess and is secured thereto, as by means of a suitable and conventional adhesive to thus fixedly join the backing sheet 21 and the gripping pad 27 together.

The gripping pad 27 has, when in a noncompressed condition, a thickness t which is significantly greater than the depth D of the recess 24 so that the exposed gripping surface 28 is spaced outwardly a substantial distance from the side surface 23 of the backing sheet. The thickness t, in a preferred embodiment, is about twice the depth D so that about 50 percent of the thickness t of the gripping pad projects outwardly beyond the surface 23. However, the extend of projection of the pad 27 beyond the surface 23 can vary over a range which is preferably between about 35 percent and about 65 percent of the overall thickness t of the pad.

The pad 27 has length and width dimensions which are significantly greater than the thickness t, although the surface area defined on the gripping surface 28 is only a very small fraction of the area defined by the side surface 23 of the backing strip 21. For example, the length of the gripping pad may be about 1 inch, and the width of the gripping pad is also about 1 inch, whereby the gripping pad extends across the full width of the backing sheet.

Further, the length of the gripping pad 27 is preferably slightly less than the length of the recess 24 so as to leave a slight clearance around the gripping pad to facilitate the compression of the gripping pad during use of the separator. Further, the clearance defined between the gripping pad and the ends of the recess, such as illustrated by FIGS. 2 and 4, helps to confine and contain any adhesive which may bleed out from between the surfaces 26 and 29.

The gripping pad 27 may be formed from a conventional highly-plasticized PVC foam gasket tape sold under the name "Cling Foam", such as a tape of 10-pound density.

In a preferred embodiment, the backing sheet 21 has a thickness of about ¼ inch, the recess 24 has a depth of about 1/32 inch, and the gripping pad 27 has a noncompressed thickness of about 2/32 inch.

Figure 5:
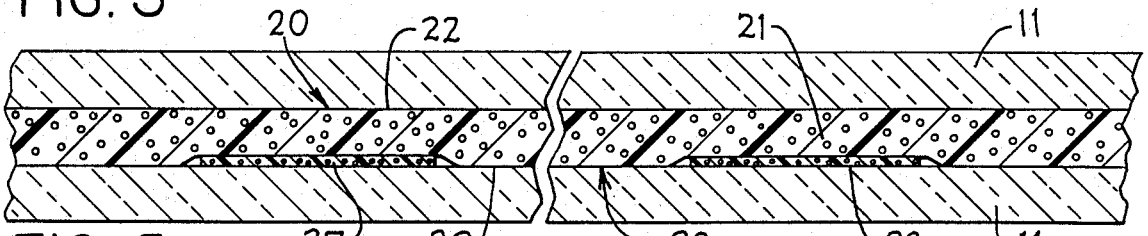
FIG. 5 is an enlarged sectional view taken substantially along line V—V in FIG. 1 and illustrating the packaging separator as it coacts between adjacent windshields.
Figure 6:
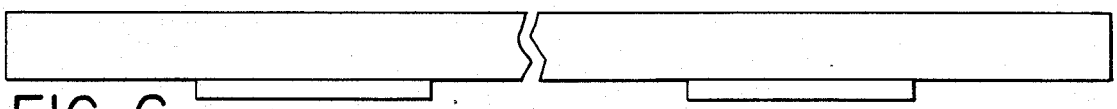
FIG. 6 is a view similar to FIG. 2 but illustrating Applicant's prior proposal for a separator, as explained above.

In use, the separator 20 is disposed between adjacent windshields 11 so that the gripping surfaces 28 of the gripping pads 27 contact the opposed surface of one windshield and create a gripping engagement therewith which resembles a releasable adhesive engagement. Due to the fact that the separator 20 is basically compressively stacked between two adjacent windshields substantially as illustrated by FIG. 5, the one windshield contacts the back surface 22 of the backing strip over substantially the complete area thereof. The other windshield initially contacts only the gripping pads 27, which pads resiliently compress to increase the gripping adherence of the pads 27 to the surface of the windshield. This compression of the pads 27 can only be of limited extent, however, inasmuch as the windshield will then contact the surface 23 of the backing sheet, whereby the compressive forces which are transmitted between the windshields through the separator 20 are for the most part transmitted directly between the surfaces 22 and 23 of the backing strip 21. The gripping pads 27, on the other hand, have only limited compression as determined by the extent of the initial projection of the gripping pads outwardly beyond the surface 23. Once the pads 27 are compressed downwardly into the recesses 24 so that the surfaces 28 are substantially coplanar with the surface 23, further compression of the gripping pads is prevented. In fact, at this condition the pressure is transmitted directly from the windshield to the surface 23, and thus the pressure between the windshield and the gripping surfaces 28 can be controlled and limited so as to achieve a desired gripping of the separator 20 to the windshield, but at the same time permit the separator 20 to be readily removed and released from the windshield when unpackaging is desired.

While the invention has been disclosed in relationship to its use as a separator between stacked windshields, nevertheless it will be appreciated that this device will also have application for use as a separator between numerous other types of horizontally or vertically stacked articles.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a packaging arrangement including rack means adapted to support a plurality of windshields thereon, a plurality of windshields mounted on said rack means, the windshields being disposed in upright condition and horizontally sidewardly adjacent one another, and a thin packaging separator sandwiched between each adjacent pair of windshields, the improvement wherein said packaging separator comprises:

a supporting sheet having generally parallel first and second side surfaces which define the thickness of the supporting sheet therebetween, said supporting sheet being of a generally nonresilient plastic foam material;

said supporting sheet having at least one shallow recess opening inwardly thereof from said first side surface, said recess being defined by a bottom wall which extends generally parallel with said first side surface and is located between said first and second side surfaces;

a sheet-like gripping member positioned within said recess and fixedly secured to said supporting sheet, said gripping member being constructed of a resilient plastic foam having adhering properties when compressed against a said windshield, said gripping member having a thickness when in a noncompressed condition which is substantially greater than the depth of said recess so that said gripping member defines thereon an outer gripping surface which is generally parallel with but spaced outwardly from said first side surface; and said separator when engaged between an adjacent pair of said windshields having said first side surface engaged with one windshield of said pair, said second side surface engaged with the other windshield of said pair, and said gripping members grippingly engaged with and compressed by said one windshield with the compression being limited to the extent that the gripping surface assumes a position generally flush with said first side surface.

2. A packaging arrangement according to claim 1, wherein said supporting sheet has a length dimension which is more than 10 times its width dimension, wherein the supporting sheet has its width dimension several times greater than its thickness dimension, and wherein said first side surface has an area of contact with the windshield which is several times greater than the area of said gripping surface.

3. A packaging arrangement according to claim 2, wherein said supporting sheet has a pair of said recesses formed in said first side surface in longitudinally spaced relationship therealong, each said recess having a said gripping member secured therein.

4. A packaging arrangement according to claim 3, wherein said recesses have a depth in the range of between about 0.2 and about 0.8 times of the thickness of said supporting sheet, and wherein said gripping member has a thickness in the uncompressed condition which is about one and one-half to about three times the depth of said recess.

5. A packaging arrangement according to claim 1, wherein said gripping member has a thickness in the uncompressed condition which is about one and one-half to about three times the depth of said recess.

6. A packaging separator adapted to be disposed between first and second articles for permitting transmission of force therebetween while maintaining said first and second articles in spaced relationship, said separator comprising:

a sheet-like supporting member having generally parallel first and second side surfaces which are spaced apart and define therebetween the thickness of the supporting member, said supporting member being constructed of a generally noncompressible and generally rigid plastic foam;

said supporting member having at least one formed shallow recess therein and opening inwardly thereof from said first side surface, said shallow recess terminating in a generally flat bottom wall which extends approximately parallel with said first side surface but is located between said first and second side surfaces, said recess having length and width cross-sectional dimensions which are substantially greater than the depth dimension as measured between said first side surface and said bottom wall;

a sheet-like gripping member positioned within said recess, said sheet-like gripping member having length and width cross-sectional dimensions which are no greater than the respective length and width cross-sectional dimensions of said recess, said sheet-like gripping member having a back surface maintained in contact with and fixedly secured to the bottom surface of said recess, said sheet-like gripping member defining thereon a front surface which is adapted to grippingly engage one of said articles, said gripping surface being generally parallel with said first side surface; and said gripping member being constructed of a resilient foam material, said sheet-like gripping member when in a noncompressed condition having a thickness which substantially exceeds the depth of said recess so that said gripping surface is spaced outwardly a substantial distance from said first side surface.

7. A separator according to claim 6, wherein said sheet-like gripping member has a thickness when in a noncompressed condition of between about one and one-half and about three times the depth of said recess.

8. A separator according to claim 7, wherein said recess has a depth in the range of about 30 percent to about 50 percent of the thickness of said supporting member.

9. A separator according to claim 7, wherein said gripping surface has an area which is a small fraction of the area of said first side surface.

10. A separator according to claim 6, wherein said supporting member is constructed of a rigid polystyrene foam, and wherein said gripping member is constructed of a highly-plasticized polyvinyl chloride foam.

11. A separator according to claim 6, wherein said supporting member is longitudinally elongated and has a length dimension which is more than ten times greater than its width dimension, and wherein said supporting member has at least two said recesses formed in said first side surface in longitudinally spaced relationship from one another, each of said recesses having a said gripping member positioned therein.

12. A separator according to claim 11, wherein said sheet-like gripping member has a thickness when in a noncompressed condition of between about one and one-half and about three times the depth of said recess.

13. A separator according to claim 12, wherein said supporting member is constructed of a rigid polystyrene foam, and wherein said gripping member is constructed of a highly-plasticized polyvinyl chloride foam.

14. A separator according to claim 6, wherein said gripping member has a thickness in the noncompressed condition of about twice the depth of said recess.

15. A separator according to claim 14, wherein said gripping surface has an area which is a small fraction of the area of said first side surface, wherein said supporting member is constructed of a rigid polystyrene foam, and wherein said gripping member is constructed of a highly-plasticized polyvinyl chloride foam.

* * * * *

UNITED STATES PATENT AND TRADEMARK OFFICE

CERTIFICATE OF CORRECTION

PATENT NO. : 4 899 880

DATED : February 13, 1990

INVENTOR(S) : Alan T. CARTER

It is certified that error appears in the above-identified patent and that said Letters Patent is hereby corrected as shown below:

Column 7, lines 1 and 2; change "formed shallow recess" to ---shallow recess formed---.

Signed and Sealed this

Twenty-ninth Day of January, 1991

*Attest:*

HARRY F. MANBECK, JR.

*Attesting Officer*

*Commissioner of Patents and Trademarks*